US010400571B2

(12) United States Patent
Evans et al.

(10) Patent No.: US 10,400,571 B2
(45) Date of Patent: Sep. 3, 2019

(54) DRILLING SYSTEM DRAG MEMBER FOR SIMULTANEOUS DRILLING AND REAMING

(71) Applicant: HALLIBURTON ENERGY SERVICES, INC., Houston, TX (US)

(72) Inventors: John Gerard Evans, The Woodlands, TX (US); Bradley Dunbar, The Woodlands, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 42 days.

(21) Appl. No.: 15/576,343

(22) PCT Filed: Jul. 2, 2015

(86) PCT No.: PCT/US2015/039096

§ 371 (c)(1),
(2) Date: Nov. 22, 2017

(87) PCT Pub. No.: WO2017/003488

PCT Pub. Date: Jan. 5, 2017

(65) Prior Publication Data

US 2018/0163480 A1 Jun. 14, 2018

(51) Int. Cl.
*E21B 44/00* (2006.01)
*E21B 44/02* (2006.01)
(Continued)

(52) U.S. Cl.
CPC ..... *E21B 44/00* (2013.01); *E21B 44/02* (2013.01); *E21B 44/04* (2013.01); *E21B 7/02* (2013.01); *E21B 7/28* (2013.01); *E21B 10/32* (2013.01); *E21B 10/322* (2013.01); *E21B 10/325* (2013.01); *E21B 41/0085* (2013.01); *E21B 49/005* (2013.01)

(58) Field of Classification Search
CPC ..... E21B 44/02; E21B 44/04; E21B 44/00
See application file for complete search history.

(56) References Cited

U.S. PATENT DOCUMENTS 5,265,684 A * 11/1993 Rosenhauch ..... E21B 17/1014 175/325.2
6,070,677 A 6/2000 Johnston, Jr.
(Continued)

FOREIGN PATENT DOCUMENTS

WO 2014105038 A1 7/2014

OTHER PUBLICATIONS

International Search Report and Written Opinion; PCT Application No. PCT/US2015/039096 dated Apr. 1, 2016.

*Primary Examiner* — Kristyn A Hall
(74) *Attorney, Agent, or Firm* — Polsinelli PC

(57) ABSTRACT

Drilling dysfunction during simultaneous down-hole drilling and reaming is reduced by obtaining an indication of force on cutters of a reamer, determining whether or not the indication indicates an excessive force, and upon determining that the indication indicates an excessive force, extending drag elements from the bottom hole assembly to contact a wall of the well bore and reduce the force on the cutters of the reamer. The indication of force on the cutters can be obtained by sensing the weight on the drill bit, and the determination can be done by comparing the indicated weight on the drill bit to a first threshold and a second threshold.

17 Claims, 6 Drawing Sheets

(51) Int. Cl.

| | |
|---|---|
| ***E21B 44/04*** | (2006.01) |
| *E21B 7/02* | (2006.01) |
| *E21B 7/28* | (2006.01) |
| *E21B 41/00* | (2006.01) |
| *E21B 49/00* | (2006.01) |
| *E21B 10/32* | (2006.01) |

(56) References Cited

U.S. PATENT DOCUMENTS

| | | | | |
|---|---|---|---|---|
| 2005/0274546 | A1 | 12/2005 | Fanuel et al. | |
| 2010/0006339 | A1 | 1/2010 | Desai | |
| 2010/0139981 | A1* | 6/2010 | Meister | E21B 7/04 175/61 |
| 2011/0247878 | A1 | 10/2011 | Rasheed | |

* cited by examiner

DRILLING SYSTEM DRAG MEMBER FOR SIMULTANEOUS DRILLING AND REAMING

CROSS-REFERENCE TO RELATED APPLICATIONS

This application is a national stage entry of PCT/US2015/039096 filed Jul. 2, 2015, said application is expressly incorporated herein in its entirety.

FIELD

The present disclosure generally relates to downhole drilling, and more specifically relates to simultaneous drilling and reaming in a well bore.

BACKGROUND

Under certain conditions, simultaneous drilling and reaming in a well bore is often desirable. Depending on formation characteristics, simultaneous drilling and reaming may offer faster penetration rates than drilling alone, or may reduce total rig time for drilling and reaming when reaming is needed. For certain formations, reaming may be needed for achieving a well bore that achieves a desired degree of smoothness or circularity. Smoothness and circularity may be important for packers to seal off selected formation layers.

Simultaneous drilling and reaming is also used for drilling a wide borehole below a narrow constriction such as a casing shoe. A bottom hole assembly including a drill bit and a reamer is selected to have a diameter less than the diameter of an aperture of the constriction, so that the bottom hole reaming can be done without drilling out the constriction. The drill bit passes through the aperture to drill a pilot hole for the reamer. Once the reamer passes through the aperture, cutters of the reamer are expanded to a diameter larger than the diameter of the aperture, so that the reamer enlarges the pilot hole to a diameter greater the diameter of the aperture.

DETAILED DESCRIPTION

Figure 1:
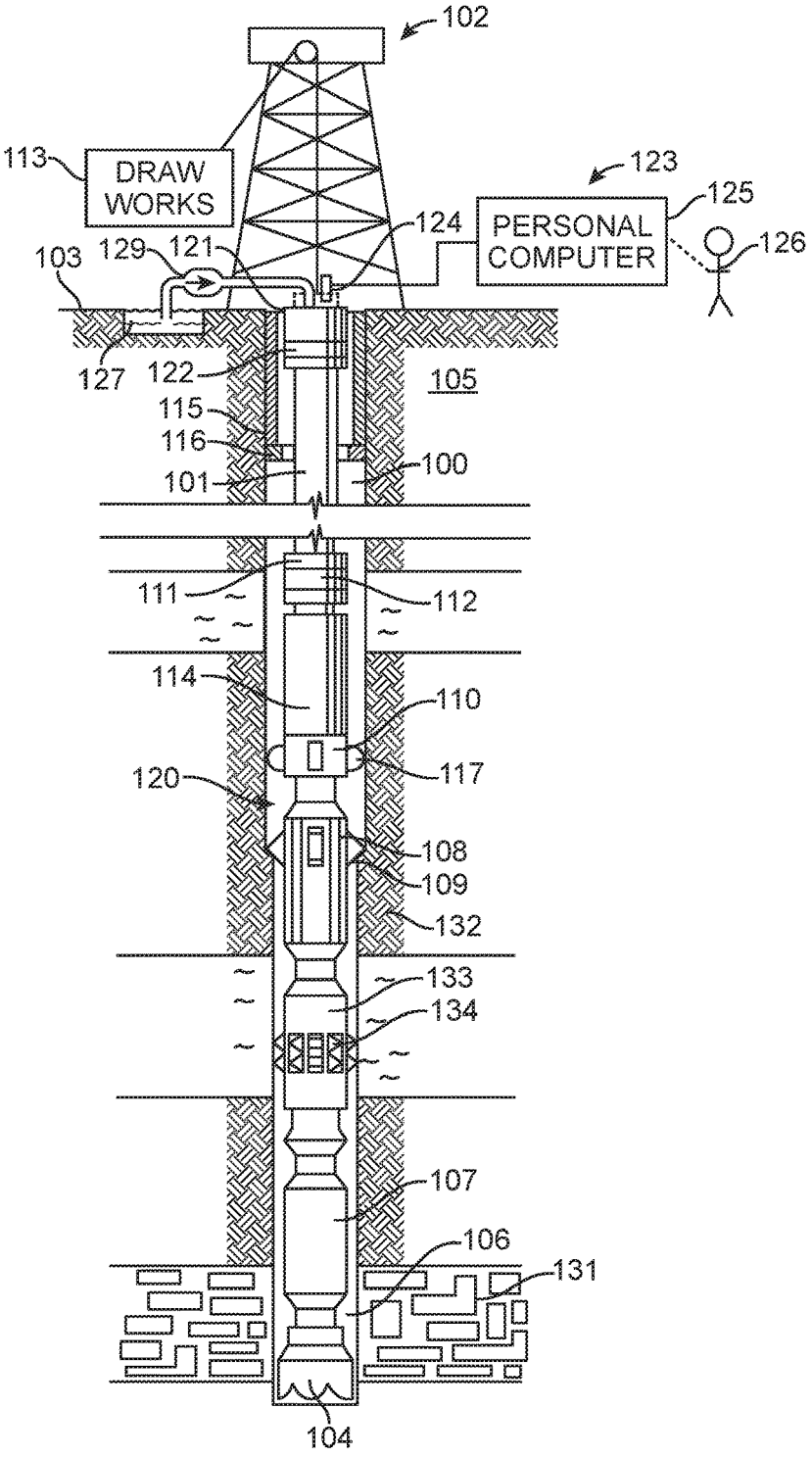
FIG. 1 is a schematic diagram of a downhole drilling system for simultaneous drilling and reaming in a well bore.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

In the following description, terms such as "upper," "upward," "lower," "downward," "above," "below," "downhole," "uphole," "longitudinal," "lateral," and the like, as used herein, shall mean in relation to the bottom or furthest extent of, the surrounding wellbore even though the wellbore or portions of it may be deviated or horizontal. Correspondingly, the transverse, axial, lateral, longitudinal, radial, and the like orientations shall mean positions relative to the orientation of the wellbore or tool.

Several definitions that apply throughout this disclosure will now be presented. The term "coupled" is defined as connected, whether directly or indirectly through intervening components, and is not necessarily limited to physical connections. The connection can be such that the objects are permanently connected or releasably connected. The term "communicatively coupled" is defined as connected, either directly or indirectly through intervening components, and the connections are not necessarily limited to physical connections, but are connections that accommodate the transfer of data between the so-described components. The term "substantially" is defined to be essentially conforming to the particular dimension, shape or other thing that "substantially" modifies, such that the component need not be exact. For example, substantially cylindrical means that the object resembles a cylinder, but can have one or more deviations from a true cylinder.

The term "radial" and/or "radially" means substantially in a direction along a radius of the object, or having a directional component in a direction along a radius of the object, even if the object is not exactly circular or cylindrical. The term "axially" means substantially along a direction of the axis of the object. If not specified, the term axially is such that it refers to the longer axis of the object.

Referring now to FIG. 1, a downhole drilling system for simultaneous drilling and reaming in a well bore 100 includes a drill string 101 supported by a rig 102 at the surface 103. A drill bit 104 at the bottom end of the drill string 101 creates a pilot hole 106 of the well bore 100 through the surrounding formation 105, which may also include formation boundaries. A pump 129 circulates drilling fluid 127, such as drilling mud, down through the drill string 101 and up the annulus around the drill string 101 to cool the drill bit 104 and remove cuttings from the well bore 100.

A sensor sub-unit 111 is situated above the drill bit 104, at the top of a bottom hole assembly (BHA) 120. The sensor sub-unit 111 carries acoustic apparatus 112 for transmitting, receiving, and processing acoustic signals passing along drill string 101 to and from the surface 103. For illustrative purposes, the sensor sub-unit 111 is shown in FIG. 1 positioned above a mud motor 114 that rotates the drill bit 104. Additional sensor sub-units, such as sub-unit 107, may be included as desired in the BHA 120. The sensor sub-unit 107 is positioned below the motor 114, and this sensor sub-unit has acoustic apparatus to communicate with the sensor sub-unit 111 in order to relay information to the surface 103. Communication between the acoustic apparatus below the motor 114 and the acoustic apparatus 112 may be accomplished by use of a short hop acoustic telemetry system.

At the surface 103, supported by the drill string 101, a surface sub-unit 121 carries acoustic apparatus 122. The surface sub-unit 121 may be supported also by the surface rig 102. Signals received at the acoustic apparatus 122 may be processed within the acoustic apparatus 122 or sent to a surface installation 123 for processing.

As shown in FIG. 1, the surface installation 123 includes a transceiver 124 for communicating with the surface sub-unit 121, and a personal computer 125 coupled to the transceiver 124 for processing the signals from the sensor sub-unit 121 and reporting results to a drilling operator 126.

The present disclosure addresses problems of simultaneous drilling and reaming in the well bore 100. In the system of FIG. 1, a reamer 108 is disposed in the BHA 120 of the drill string 101 below the motor 114 and between the motor and the drill bit 104 so that the reamer 108 is rotated in synchronism with the drill bit. The reamer 108 has a circular row of blades 109 disposed around the periphery of the reamer for enlarging the diameter of the pilot hole 106.

The reamer 108 may include an actuator for selectively extending the blades 109 radially outward or retracting the blades radially inward. For example, in an initial position, the blades 109 do not extend from the outer housing of the reamer 108, so that the blades would not enlarge the pilot hole. Therefore it is possible for the drill bit 104 and the reamer 108 to pass through a restriction such as an aperture of a casing shoe 116 on the bottom of a well casing 115, and then the blades of the reamer 109 can be selectively actuated to extend the blades radially outward to enlarge the pilot hole 106 to a diameter greater than the diameter of the aperture. A suitable reamer 108 having such a capability is the XR™ brand hole enlargement tool sold by Halliburton Energy Services, Inc.

The simultaneous drilling and reaming may include rotary steerable drilling. For this purpose, a steering unit 110 is attached to the bottom of the housing of the mud motor 114. The steering unit 110 may include a push-the-bit system, where the steering unit 110 has a circular row of pushers 117 disposed around the outer circumference of the steering unit 110 and actuated to push against a selected circumferential position of the wall of the well bore 100. This pushing causes the drill bit 104 to deviate the drilling of the pilot hole 106 in the diametrically opposite direction. The pushers 117 can also be selectively retracted radially inward so that the pushers do not extend from the outer housing of the steering unit 110. In addition various point-the-bit rotary steerable systems can be suitably employed.

During the simultaneous drilling and reaming in the well bore 100, problems may arise when the drill bit 104 begins drilling into a different formation layer 131 having different characteristics. For example, the formation layer 131 may contain rock that is much softer or more brittle than the formation layer 132 being reamed by the reamer 108. In this situation, the drill bit 104 is more effective in drilling than the reamer 108 is effective in reaming, so that the drilling proceeds at a faster penetration rate than the reaming, and there is a rapid decrease in the weight and torque on the drill bit 104, and a rapid increase in the weight and torque on the cutters 109 of the reamer 108. The problem is particularly troublesome when the weight on the bit (WOB) 104 is normally much larger than the weight on the cutters 109 of the reamer 108.

For example, the WOB may normally be four times the weight on the cutters 109 of the reamer 108. This relationship is often expressed in terms of respective percentages of the total weight of the drill string 100 that is supported by the subterranean formation 105. In this case the WOB is 80 percent, and the weight on the cutters 109 of the reamer 108 is 20 percent, of the total weight. If the drill bit 104 begins drilling into an extremely soft and brittle foundation layer, then the weight on the cutters 109 of the reamer 108 may suddenly increase by more than a factor of four. Such a large and sudden increase in the weight upon the cutters 109 may cause temporary dysfunction of the reamer 108, and may also reduce the mean time before failure of the cutters or the reamer due to the transient forces upon the cutters.

The temporary dysfunction of the reamer 108 has various symptoms such as an increase in torque on the reamer cutters 109 due to an increase in the depth of cut of the reamer cutters, stick slip followed by whirl in the rotation of the reamer and the drill bit 104, and also vibration of the reamer and the drill bit, which may result in a loss of smoothness and circularity in the reamed borehole. The vibration may include an axial vibration of the drill string leading to an oscillation in which the total supported weight is shifted back-and-forth between the cutters 109 of the reamer 108 and the drill bit 104, which may cause drilling dysfunction as well as reaming dysfunction, such as stick slip at the drill bit and transient loads upon the drill bit.

In order to reduce drilling dysfunction due to a shift in weight and torque from the drill bit 104 to the cutters 109 of the reamer 108, a drag member 133 is included in the bottom hole assembly (BHA) 120 of the reamer and the drill bit so that the drag member is rotated in synchronism with the reamer and the drill bit. The drag member 133 has circumferentially disposed drag elements 134 that are radially extendable to contact the wall of the well bore 100 for creating a drag force reducing the weight on the cutters 109 of the reamer 108 when the weight on the cutters becomes excessive. Contact of the drag elements 134 with the wall of the well bore 100 may also create a drag force opposing the rotation of the reamer 108 in order to reduce the circumferential force (i.e., the torque) upon the cutters 109. Contact of the drag elements with the wall of the well bore 100 may also create drag forces that oppose vibration of the BHA 120 and therefore frictionally dampen vibration of the BHA.

One particular location of the drag member 133 in the BHA 120 can be below the reamer 108, between the reamer 108 and the drill bit 104. At this location, the extension of the drag elements 134 to contact the borehole wall is less that would be required if the drag member 133 would otherwise be disposed above the reamer 108. In another example, the drag unit 108 shares the housing of the reamer 108, and in this case the location of the drag elements 134 can be below the cutters 109 of the reamer 108 in the shared housing.

In the example of FIG. 1, the drag member 133 is located directly below the reamer 108, and above the sub-unit 107. The sub-unit 107 is directly above the drill bit 104, in order to contain sensors that sense the operation of the drill bit, or to contain additional devices for steering the drill bit 104. In another example, the sub-unit 107 is omitted so that the drag unit 133 is disposed in the BHA 120 just above the drill bit. In yet another example, more than one drag unit is disposed between the reamer 108 and the drill bit 104. In still another example, more than one sensor or steering sub-unit is disposed below the reamer 108 and just above the drill bit 104 in the BHA 120.

In one particular form of construction, the drag elements 134 have outward facing portions that are shaped and positioned for rubbing against the borehole wall rather than cutting. The outward facing portions may be hardened or made of hard durable wear-resistant materials such as tungsten carbide, polycrystalline diamond compact (PDC), or particle-matrix composite material having hard particles.

In accordance with one example, the drag elements do not cut the wall of the well bore when the drag elements contact the wall of the well bore and reduce the force on the cutters of the reamer. In general, there is a region of contact between a drag element and the wall of the well bore, and force of the drag element upon the wall of the well bore may or may not cut the wall of the well bore by shearing of the rock of well bore in front of the region of contact in the circumferential direction of motion of the drag element as the drag unit is rotated within the well bore. In practice, shearing of hard rock of the well bore in front of the region of contact will not occur if the "rake angle" of the drag element is more negative than −60 degrees, because the drag element would deform or fracture before the hard rock of the well bore would shear in front of the region of contact. The "rake angle" of the drag element is defined herein as the angle of the leading face of the drag element where the leading face of the drag element contacts the wall of the well bore. This rake angle is measured with respect to the radial direction in a plane perpendicular to the axis of the well bore, and a rake angle in the circumferential direction of motion of the drag element is defined as negative. Therefore, as defined herein, "the drag elements do not cut the wall of the well bore" means that the drag elements have rake angles more negative than −60 degrees when the drag elements contact the wall of the well bore and reduce the force on the cutters of the reamer.

The drag elements 134 are extended outward to contact the wall of the well bore 100 in response to sensing an indication of excessive force upon the cutters 109 of the reamer 108. For example, the reamer 108 can be provided with load sensors directly sensing the force upon the cutters 109. Often a more convenient indication of excessive force upon the cutters 109 of the reamer 108 is the weight upon bit (WOB) during simultaneous drilling and reaming operations in the well bore 100, because the WOB is often sensed anyway for monitoring of the performance of the drill bit 104 during logging while drilling (LWD). In this case, the condition of excessive force upon the cutters 109 of the reamer 108 can be determined from the sensed WOB.

For example, during simultaneous drilling and reaming in the well bore 100, draw works 113 associated with the drilling rig 102 ensure that there is a generally constant total weight ($W_{total}$) that is the sum of the WOB and the weight upon the cutters 109 of the reamer 108. Also the subdivision of the total weight ($W_{total}$) between the WOB and the weight upon the cutters 109 of the reamer 108 during normal simultaneous drilling and reaming in the well bore 100 can be estimated in advance for a given type of reamer 108 and a given type of drill bit 104 based on the percent enlargement of the well bore diameter that the reamer 108 will be set for. To monitor the operation of the drill bit 104, the sensor sub-unit 107 often has a load sensor sensing the WOB. Therefore the weight upon the cutters 109 of the reamer 108 is the difference ($W_{total}$−WOB) between the total weight and the WOB. If the sub-unit 107 were omitted from the system of FIG. 1, then a load sensor sensing the WOB may be included in the drag unit 133.

Various kinds of controllers may be used to activate an actuator to extend the drag elements 134 to contact the wall of the well bore 100 when there is excessive force upon the cutters 109 of the reamer 108 during simultaneous drilling and reaming in the well bore 100. For example, the controller may be mechanical, hydraulic, hydro-mechanical, electro-mechanical, electronic, or combinations thereof. Weight or torque sensing and control may be entirely self-contained and autonomous within the drag member 133. In another example, weight or torque sensing may occur in the reamer 108 or in the sensor sub-unit 107, and the controller may be contained entirely within the drag member 133. In yet another example, weight or torque sensing may occur in the reamer 108 or in the sensor sub-unit, and the sensor signals may be sent to the surface 113, and the computer 125 at the surface may compute position set-points for the drag elements 134, and the computer 125 at the surface may send the position set-points back down the well bore 100 to the drag member 133, and an actuator in the drag member may extend or retract the drag elements 134 in response to the position set-points. The computer 125 at the surface 103 may also send a position set-point to retract the drag elements 134 for pulling the drill string 101 up from the well bore 100.

Figure 2:
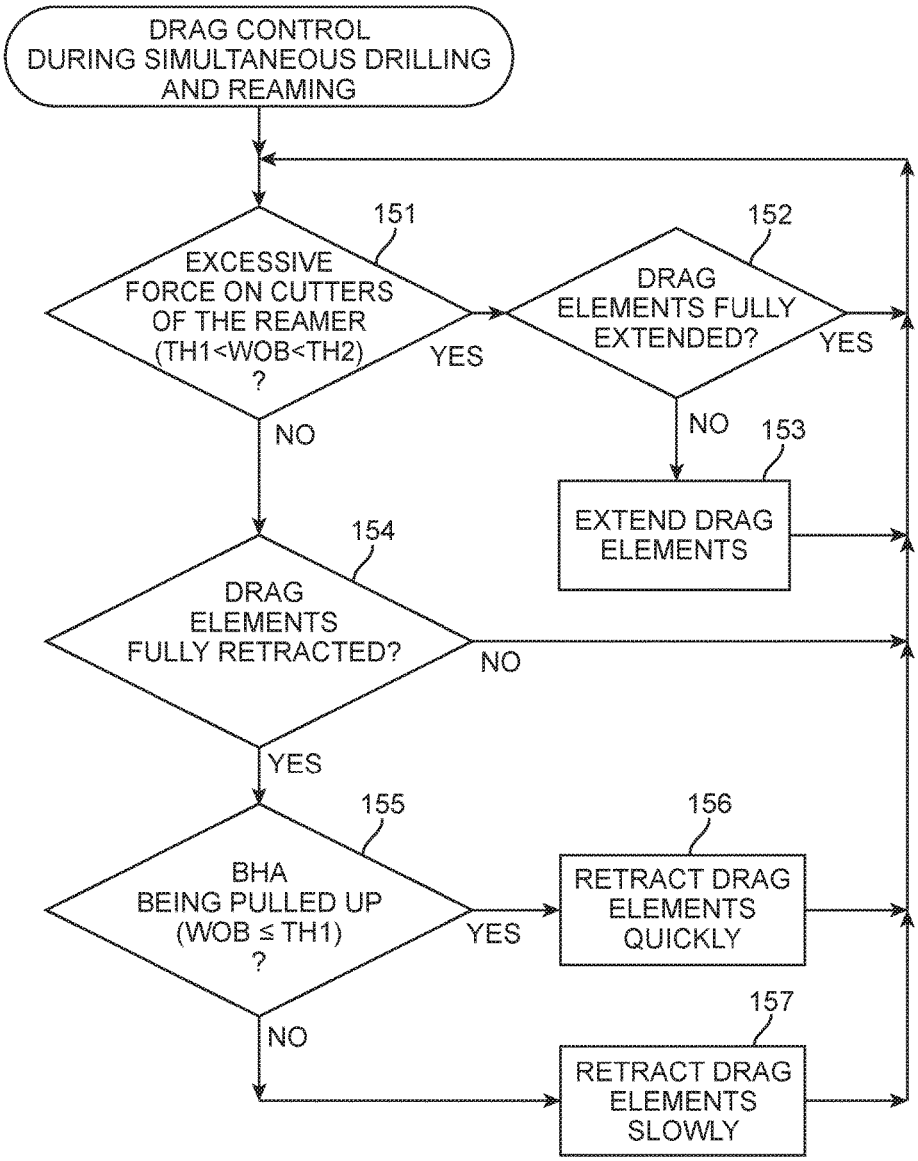
FIG. 2 is a flow chart of a method of drag control during simultaneous drilling and reaming in a well bore.

FIG. 2 shows an example of a control procedure for controlling the position of the drag elements in response to a signal indicating force upon the reamer cutters. In a first box 151, it is determined whether or not the signal indicates excessive force upon the reamer cutters. For example, there is excessive force upon the reamer cutters if the signal indicates a force that is greater than a certain value. In particular, excessive force upon the reamer cutters is indicated if the weight on bit (WOB) is greater than a first threshold (TH1) and less than a second threshold (TH2). In a specific example, the WOB is normally eighty percent of the total weight ($w_{total}$), and a WOB less than five percent of the total weight does not occur unless the draw works pulls the drill string up the well bore. In this specific example, the first threshold five percent of the total weight, and the second threshold is seventy percent of the total weight.

The control procedure branches from box 151 to 152 in response to determining that the indication of force on the cutters of the reamer indicates an excessive force on the cutters of the reamer. In step 152, if the drag elements are already fully extended, then the control procedure loops back to box 151. Otherwise, the control procedure continues from box 152 to box 153. In box 153, the drag elements are extended further, and then the control procedure loops back to box 151.

If box 151 determines that the indication of force on the cutters of the reamer does not indicate an excessive force on the cutters of the reamer, then the control procedure continues from box 151 to box 154. In box 154, if the drag elements are not fully retracted, then the control procedure loops back to box 151. Otherwise, the control procedure continues from box 154 to box 155. In box 155, if the BHA is being pulled up the well bore, then the control procedure branches from box 155 to box 156. In box 156, the drag elements are retracted quickly to remove any resistance of the drag elements to the raising of the BHA, and then the control procedure loops back to box 151.

If box 155 determines that the BHA is not being pulled up the well bore, then the control procedure continues from box 155 to box 157. In box 157, the drag elements are retracted slowly, in comparison to the extension in box 153, and then the control procedure loops back to box 151. Thus, the control procedure in FIG. 2 is an example of an iterative closed control loop. The speed at which the drag elements are extended in box 153 should be comparable to the time taken for the depth of cut of the reamer cutters to respond to the drill bit cutting through a formation and into a softer formation. The speed at which the drag elements are retracted in box 157 should be slower to dampen vibrations. The relative speeds could be responsive to the amount of excessive force upon the reamer cutters (i.e., the difference TH2−WOB), and the relative speeds could also be responsive to the amount of time that the force upon the reamer cutters has been excessive, so that the control procedure in FIG. 2 would function as a kind of proportional-integral-differential (PID) controller.

FIGS. 3, 4, 5, and 6 show a drag member 170 using a self-contained mechanical control system powered by the WOB itself for extending and retracting drag elements 171. The drag elements 171 are arranged in two circular rows of eight drag elements in each row, and the drag elements in each row are spaced at forty-five degree increments around the circumference of the drag member 270.

In this example, the drag member 170 has a mechanical controller in the form of a spring-loaded splined pipe joint having a variable length responsive to axial force upon the spring-loaded splined pipe joint. The spring-loaded splined pipe joint includes a splined upper central pipe segment 183, a splined lower central pipe segment 184, and a spring 172. The splined upper central pipe segment 183 is received in the splined lower central pipe segment 184. In this example, the spring 172 is a helical compression spring. The spring 172 has a spring constant selected so that the spring determines whether or not axial force on the spring-loaded splined pipe joint indicates an excessive force on the cutters of the reamer. When the axial force indicates an excessive force on the cutters of the reamer, the variable length of the spring-loaded splined pipe joint actuates a mechanical mechanism to extend the drag elements 171 to contact the wall of the well bore.

Figure 5:
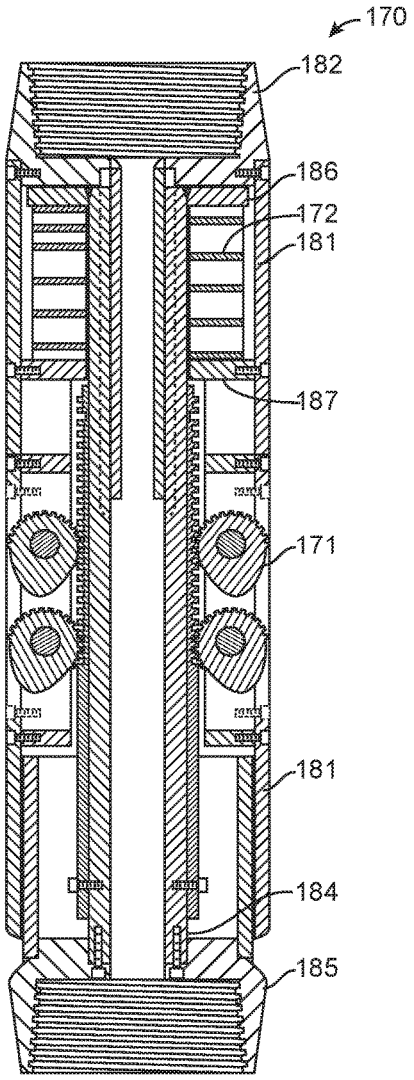
FIG. 5 is a cross-section view of the drag member of FIG. 4 in a state for at least 80 percent weight on bit (WOB)
Figure 6:
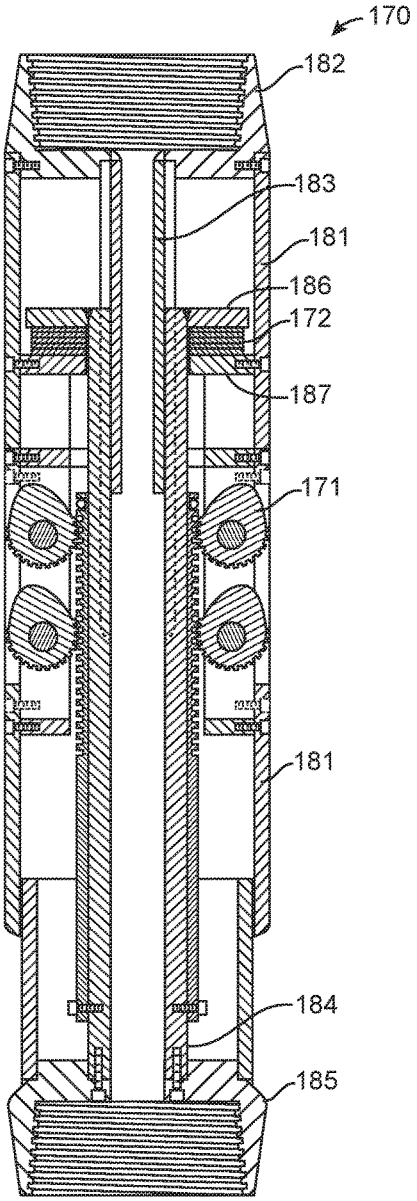
FIG. 6 is a cross-section side view of the drag member of FIG. 4 in a state for no weight on bit (WOB)

When used in a BHA (e.g., 120 in FIG. 1) during simultaneous drilling and reaming, the drag member 170 is a splined telescoping pipe joint for transmitting torque from the mud motor (114 in FIG. 1) to the drill bit (104 in FIG. 1) while permitting the length of the drag member to shorten down to a lower limit as the WOB increases and to lengthen up to an upper limit as the WOB decreases. The lower limit is reached, as shown in FIG. 5, for the WOB during simultaneous drilling and reaming operations during normal conditions (i.e., the reamer and drill bit are cutting into the same common type of formation). The upper limit is reached, as show in FIG. 6, when the draw works (113 in FIG. 1) pulls the BHA up the well bore.

Figure 3:
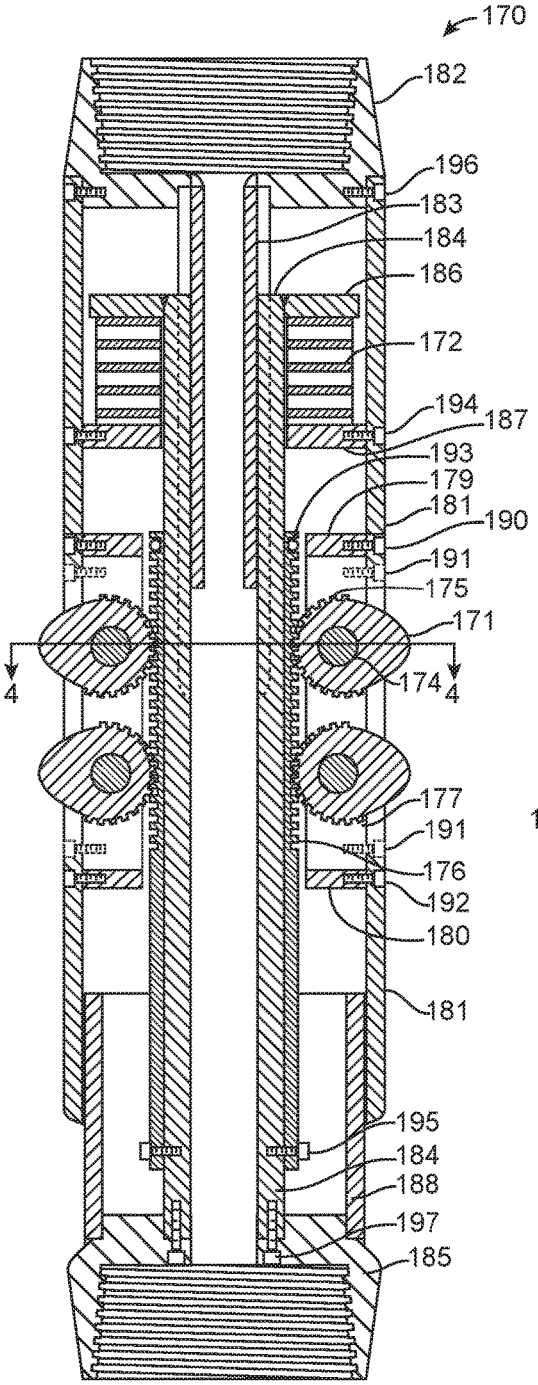
FIG. 3 is a cross-section side view of a first example of a drag member in a state for maximum drag.
Figure 4:
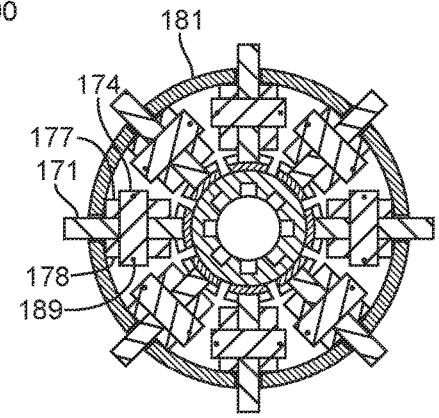
FIG. 4 is a cross-section top view of the drag member along line 4-4 in FIG. 3.

FIG. 3 shows the drag member 170 when the drag elements 171 are fully extended, which occurs for a particular WOB selected by the spring constant of the spring 172. For example, this particular WOB is sixty percent of the total weight ($W_{total}$), and at this particular WOB the force on the reamer cutters would be more than excessive. In this example, the fully extended configuration of the drag elements 171 has an outer diameter of about one percent greater than the inner diameter of the pilot hole. For example, the outer diameter is 12 and ⅜ inches (31.12 cm), and the pilot hole has an inner diameter of 12 and ¼ inches (31.43 cm).

In the example of FIG. 3, the drag elements 171 are lobed cams that rotate about respective shafts 174 in order to extend or retract the lobes of the cams. The internal half of each drag element 171 is formed with pinion gear teeth 175 that mesh with teeth of a respective rack 176 that is fastened to the lower end of the drag member 170. Each drag element 171 is disposed between a respective pair of rectangular parallel plates 177, 178 to which the respective shaft 174 is mounted. The pairs of rectangular plates 177, 178 extend in longitudinal and radial directions and are received at their upper and lower ends in respective upper and lower annular plates 179, 180. The rectangular plates 177, 178 and the annular plates 179, 180 are received in and secured to an upper cylindrical tubular outer housing 181 attached to an upper end of the drag member 170. When extended, the lobes of the drag elements 171 protrude out of respective rectangular windows cut in the upper outer housing 181.

In general, the drag member 170 is fabricated from steel tubes and steel plates welded or fastened together with fasteners such as machine screws. For example, the drag member 170 has an upper annular internally threaded pipe connector 182 welded to an upper cylindrical central pipe segment 183. The internal pipe segment 183 is machined with an outer spline mating with an inner spline machined into a lower central cylindrical pipe segment 184. A lower annular internally threaded pipe connector 185 is secured to the lower end of the lower central pipe segment 184. In this fashion the upper and lower central pipe segments provide a central lumen for the flow of drilling fluid from the upper pipe connector 182 to the lower pipe connector 185, while also transmitting torque from the upper pipe connector 182 to the lower pipe connector 185. An annular plate 186 is secured to the top of the lower central pipe segment 184 to apply force to the top of the spring 172. An annular plate 187 is received in and secured to the upper outer housing 181 to apply force to the bottom of the spring 172. Thus, the spring 172 encircles the lower central pipe segment 184 and the spring 172 is held between the annular plates 186 and 187. A lower cylindrical tubular outer housing 188 is secured to the lower pipe connector 185, and the lower cylindrical tubular outer housing 188 is fitted into the upper cylindrical tubular outer housing 181.

The drag member 170 can be assembled in the following way. First, the drag elements 171 are fitted onto their respective shafts 174, and then the shafts 174 are fitted into the respective pairs of rectangular plates 177, 178 so that the drag elements are sandwiched between their respective pairs of rectangular plates. The assembly of each pair of rectangular plates 177, 178 and its associated drag elements 171 and shafts 174 is held together by a respective cotter pin 189 inserted into a hole at each end of each shaft 174. The upper annular plate 179 is inserted into and fastened to the upper outer housing 181 with machine screws 190. Then the assembly of each pair of rectangular plates 177, 178 is inserted into the upper outer housing 181 and fitted to the upper annular plate 181, and then fastened to the upper outer cylindrical tubular housing 181 with machine screws 191. Then the lower annular plate 180 is inserted into the upper outer housing 181 and fitted onto the pairs of rectangular plates 177, 178 and fastened to the upper outer housing 181 with machine screws 192. Then the upper ends of the racks 176 are coupled together by a flexible O-ring 193 and inserted into the central region of the upper outer housing 181 and placed against and meshed with their associated pinion teeth 175 of the drag elements 171. Then the annular plate 187 is inserted into the upper outer housing 181 and fastened to the upper outer housing 181 with machine screws 194. Then the spring 172 is inserted into the upper outer housing 181 and seated onto the annular plate 187. Then an assembly of the lower inner pipe segment 184 and the annular plate 186 is inserted into the upper outer housing 181 until the spring 172 is compressed as shown. Then the racks 176 are fastened to the lower inner pipe segment 184 by machine screws 195. Then an assembly of the upper pipe connector 182 and the upper inner pipe segment 183 is fitted into the lower inner pipe segment 184 and into the upper outer housing 181, and the upper pipe connector 182 is fastened to the upper outer housing 181 by machine screws 196. Then an assembly of the lower pipe connector 185 and the lower outer housing 188 is inserted into the upper outer housing 181 and fitted onto the lower inner pipe segment 184 and fastened to the lower inner pipe segment by machine screws 197.

Figure 7:
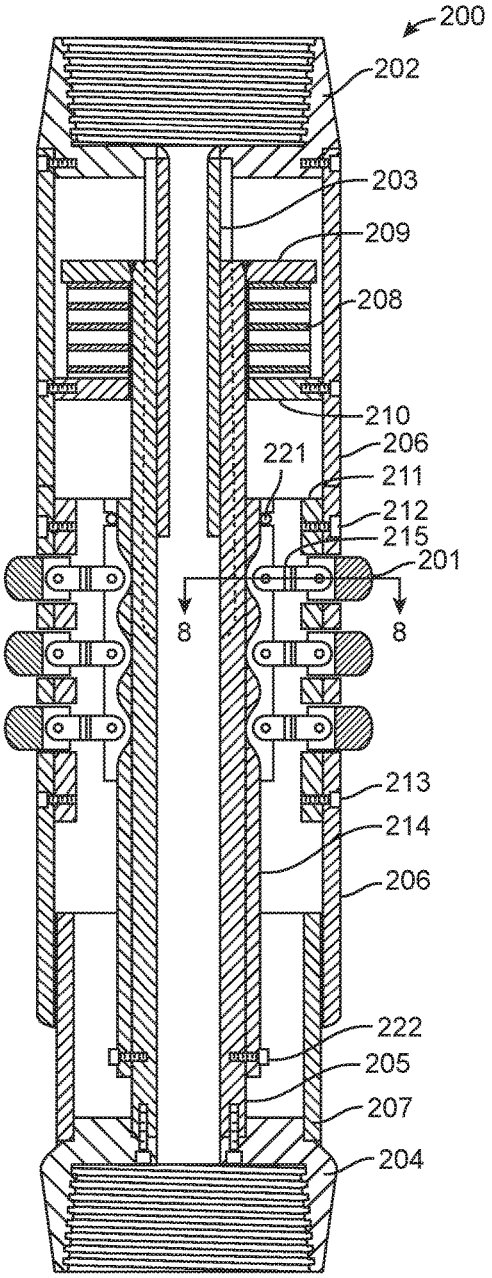
FIG. 7 is a cross-section side view of a second example of a drag member in a state of maximum drag.

FIG. 7 shows a second example of a drag member 200 that is similar to the drag member 170 of FIG. 3 except that piston drag elements 201 and a linkage mechanism for actuating the piston drag elements has been substituted for the lobed drag elements 171 and the rack-and-pinion mechanism for actuating the lobed drag elements. The drag member 200 is shown in FIG. 7 for the condition of maximum radial extension of the drag elements 201.

The drag member 200 has an upper internally threaded annular pipe connector 202 secured to an externally splined upper internal pipe segment 203, and a lower internally threaded annular pipe connector 204 secured to an internally splined lower internal pipe segment 205 that mates with the externally splined upper internal pipe segment 203. The drag member 200 also has an upper cylindrical and tubular outer housing 206 fastened to the upper pipe connector 202 and a lower cylindrical and tubular outer housing 207 fastened to the lower pipe connector 204 and received in the upper outer housing 206. The drag member 200 also has a helical compression spring 208 encircling the inner pipe segments and confined between an upper annular plate 209 secured to the lower inner pipe segment 205 and a lower annular plate 210 secured to the upper outer housing 206. Therefore the inner pipe segments 203, 204 may convey drilling fluid from the upper pipe connector 202 to the lower pipe connector 204 while transmitting torque from the upper pipe connector 202 to the lower pipe connector. Moreover, the drag member 200 has a variable length responsive to axial force between the upper pipe connector 202 and the lower pipe connector 204. The spring 208 has a spring constant selected so that the drag elements 201 are fully extended, as shown, when the force on the cutters of the reamer would be more than excessive during simultaneous drilling and reaming in a well bore.

The piston drag elements 201 are disposed in respective holes of a cylindrical and tubular cylinder block 211 fitted inside the upper outer housing 201 and fastened to the upper outer housing 201 with machine screws 212, 213. When fully extended, the piston drag elements protrude radially through respective circular holes in the upper outer housing 206. On the outer periphery of the upper outer housing 201, the piston drag elements 201 are arranged in three circular rows, and in each row, the piston drag elements are spaced at regular angular increments, such as forty-five degrees for eight drag elements per row. The mechanism for actuating the piston drag elements 201 includes an axial elongated bar 214 for each column of three drag elements, and a respective link 215 coupling the bar 214 to each of the three drag elements in the column.

Figure 8:
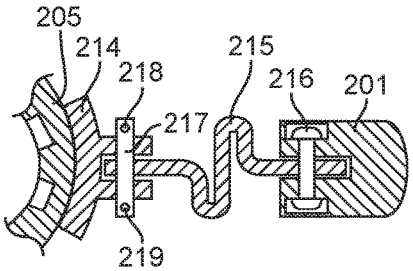
FIG. 8 is a cross-section top view of a piston and connecting link along line 8-8 in FIG. 7.

As shown in FIG. 8, the link 215 is sinuous for resiliency. A piston pin 216 attaches the piston drag element 201 to one end of the link 215, and a pin 217 attaches the other end of the link 215 to the bar 214. When the bar 214 is raised or lowered from the condition of maximum extension as show in FIG. 7, the piston drag elements are retracted in the radial direction.

During assembly, the cylinder block 211 is inserted in the upper outer housing and fastened to the upper outer housing with the machine screws 212, 213. Then three piston drag elements 201 and their respective links 215 are secured to the bar 214 with three respective pins 217, and each pin 217 is held in place in the bar 214 with a respective cotter pin 218, 219 in each end of the pin 217. Then the assembly of the three piston drag elements 201 and the one bar are inserted into the upper outer housing 206 and the piston drag elements are inserted into their respective holes in the cylinder block 211. This is repeated for the other piston drag elements 201 and the other bars 214 until all of the piston drag elements 201 have been inserted into the cylinder block 211. The upper ends of the bars 214 are coupled together by a resilient O-ring 221. Once the lower inner pipe section 205 has been inserted into the upper outer housing 206, the lower ends of each bar 215 is fastened to the lower inner pipe 214 with a machine screw 222.

Figure 9:
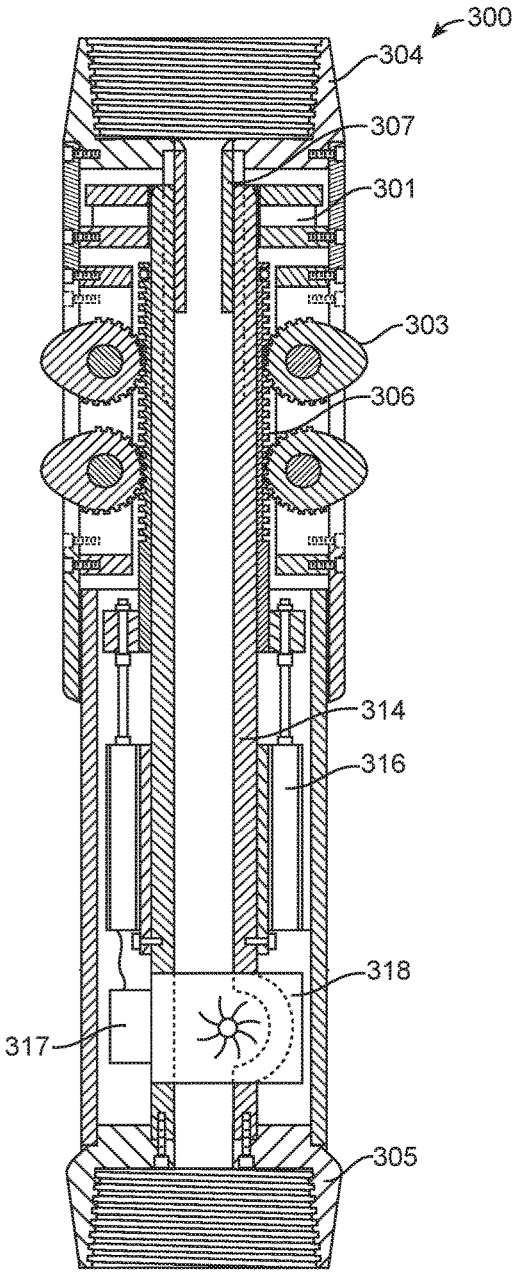
FIG. 9 is a cross-section side view of a third example of a drag member in a state of maximum drag.

FIG. 9 shows another drag member 300. The drag member 300 is similar to the drag member 170 of FIG. 3 except that a load cell 301 has been substituted for the compression spring (172 in FIG. 3), and the racks 306 are coupled to the lower inner pipe 314 via linear electrical actuators 316. The drag member 300 also includes an electronic controller 317 for controlling the actuators 316 in response to a load signal form the load cell 301, and a turbo-generator 318 for powering the load cell 301, the electronic controller 317, and the actuators 316 from the flow of drilling fluid through the lower inner pipe 314.

Figure 10:
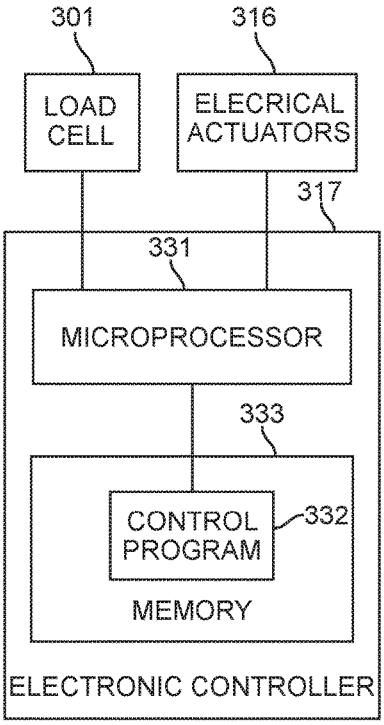
FIG. 10 is a block diagram of an electronic controller used in the drag member of FIG. 9.

For example, as shown in FIG. 10, the electronic controller 317 includes a microprocessor 331 executing instructions of a control program 332 stored in a memory 333 (such as electrically erasable and programmable read-only memory) to perform the control procedure of FIG. 2 to control the actuators 316 in response to a load signal from the load cell 301. The use of an electronic controller 317 has the advantage that the thresholds (TH1 and TH2 in box 151 of FIG. 2) are easily adjusted by changing numerical values in the control program. Therefore it is convenient to adjust these thresholds for a different kind of bit or reamer or a change in the number of sub-units below the drag member 300 in the BHA.

The drag member 300 could be modified in various ways to incorporate alternative features described above with reference to the other figures. For example, the lobed drag elements 303 and the rack-and-pinion mechanism for actuating the lobed drag elements could be replaced with the piston drag elements and the linkage mechanism for actuating the piston drag elements as shown in FIGS. 7 and 8. Moreover, if a load sensor sensing the weight or torque on the reamer cutters was included in the reamer, or if a load sensor sensing the weight or torque on the bit were included in another sub-unit below the reamer in the BHA, then the load cell 301 could be omitted from the drag unit 300 and the electronic controller 317 could respond instead to the load signal from the load sensor in the reamer or in the other sub-unit. Furthermore, if the load cell 301 were omitted from the drag unit 300, then the splined inner pipe segments 307, 314 could be replaced with a single inner pipe segment having an upper end attached to the upper pipe connector 304 and a lower end attached to the lower pipe connector 305.

The drag members in FIGS. 5 to 9 also could be modified so that the actuator mechanism for extending and retracting the drag elements of the drag member would be responsive to the torque rather than the axial force transmitted between the upper pipe connector and the lower pipe connector. For example, the lower central pipe segment would not have a splined connection with the upper central pipe segment so that the upper pipe connector would rotate with respect to the lower pipe connector in response to the torque, and the actuator mechanism would be responsive to the rotation of the upper pipe connector relative to the lower pipe connector. For example, the rotation could rotate a screw that would translate the racks in a drag member similar to the drag member 170 in FIG. 3, or that would translate the bars in a drag member similar to the drag member 200 in FIG. 7. The drag member 300 of FIG. 9 could be modified to respond to the torque rather than the axial force by omitting the splined connection between the upper central pipe section 307 and the lower central pipe section 314 and using a load cell 301 configure to sense the torque rather than the axial force.

Numerous examples are provided herein to enhance understanding of the present disclosure. A specific set of examples are provided as follows.

In a first example, there is disclosed a method of simultaneous drilling and reaming using a drill bit and a reamer in a bottom hole assembly to bore and ream a well bore, said method comprising: (a) obtaining an indication of force on cutters of the reamer; (b) determining whether or not the indication of force on the cutters of the reamer indicates an excessive force on the cutters of the reamer; and (c) in response to determining that the indication of force on the cutters of the reamer indicates an excessive force on the cutters of the reamer, extending drag elements from the bottom hole assembly to contact a wall of the well bore and reduce the force on the cutters of the reamer.

In a second example, a method is disclosed according to the preceding first example, wherein the drag elements do not cut the wall of the well bore when the drag elements contact the wall of the well bore and reduce the force on the cutters of the reamer In a third example, a method is disclosed according to the preceding first or second example, further comprising obtaining the indication of force on the cutters of the reamer from an indication of force on the drill bit.

In a fourth example, a method is disclosed according to any of the preceding examples, further comprising comparing indicated weight on the drill bit to a first threshold and a second threshold and finding that weight on the drill bit is between the first threshold and the second threshold in order to determine that the indication of force on the reamer indicates an excessive force on the cutters of the reamer.

In a fifth example, a method is disclosed according to any of the preceding examples, further comprising retracting the drag elements from the wall of the well bore in response to determining that the bottom hole assembly is being pulled up the well bore.

In a sixth example, a method is disclosed according to any of the preceding examples, further comprising determining that the bottom hole assembly is being pulled up the well bore by comparing an indicated weight on the drill bit to a threshold and finding that the weight on the drill bit is less than the threshold.

In a seventh example, a method is disclosed according to any of the preceding examples, further comprising converting axial force on a drag member of the bottom hole assembly to a variable length of the drag member in order to obtain the indication of force on the cutters of the reamer.

In an eighth example, a method is disclosed according to the any of the preceding examples, further comprising actuating a mechanical mechanism with the variable length of the drag member in order to extend the drag elements from the bottom hole assembly to contact the wall of the well bore.

In a ninth example, a method is disclosed according to the any of the preceding examples, further comprising a spring determining whether or not the indication of force on the cutters of the reamer indicates an excessive force on the cutters of the reamer in order to extend the drag elements to a contact the well bore wall when the force on the cutters of the reamer becomes excessive.

In a tenth example, there is disclosed a bottom hole assembly for simultaneous drilling and reaming in a well bore, the bottom hole assembly comprising: a reamer having cutters disposed around an outer circumference of the reamer; a drill bit at a bottom end of the bottom hole assembly; drag elements extendable from the bottom hole assembly to contact a wall of the well bore; an actuator mechanism mechanically coupled to the drag elements to extend the drag elements to contact a wall of the well bore and to retract the drag elements from the wall of the well bore during the simultaneous drilling and reaming; a load sensor for producing a load signal indicating force on the cutters of the reamer during the simultaneous drilling and reaming; and an electronic controller electronically coupled to the load sensor for receiving the load signal and electronically coupled to the actuator mechanism for activating the actuator mechanism when the load signal indicates an excessive force on the cutters of the reamer during the simultaneous drilling and reaming in the well bore.

In an eleventh example, there is disclosed a bottom hole assembly according to the preceding tenth example, wherein the electronic controller is programmed to activate the actuator mechanism to retract the drag elements from the wall of the well bore in response to the load signal indicating that the bottom hole assembly is being pulled up the well bore.

In a twelfth example, there is disclosed a bottom hole assembly for simultaneous drilling and reaming in a well bore, the bottom hole assembly comprising: a reamer having cutters disposed around an outer circumference of the reamer; a drill bit at a bottom end of the bottom hole assembly; drag elements extendable from the bottom hole assembly to contact a wall of the well bore; an actuator mechanism mechanically coupled to the drag elements to extend the drag elements to contact a wall of the well bore and to retract the drag elements from the wall of the well bore during the simultaneous drilling and reaming; and a spring-loaded splined pipe joint having a variable length responsive to axial force upon the spring-loaded splined pipe joint, wherein the actuator mechanism is mechanically coupled to the spring-loaded splined pipe joint to extend and retract the drag elements in response to the variable length of the spring-loaded splined pipe joint.

In a thirteenth example, there is disclosed a bottom hole assembly according to any of the preceding tenth to twelfth examples, wherein the drag elements are lobed cams having pinion gear teeth, and the actuator mechanism includes at least one rack engaging the pinion gear teeth to rotate the lobed cams to extend the lobes of the cams to contact the wall of the well bore.

In a fourteenth example, there is disclosed a bottom hole assembly according to the preceding any of the preceding tenth to twelfth examples, wherein the drag elements are pistons, and the actuator mechanism includes a respective link to each of the pistons.

In a fifteenth example, there is disclosed an apparatus for a bottom hole assembly including a reamer and a drill bit for simultaneous drilling and reaming in a well bore, the apparatus comprising: an upper pipe connector at an upper end of the apparatus for connecting the upper end of the apparatus to upper components of a drill string; a lower pipe connector at a lower end of the apparatus for connecting the lower end of the apparatus to lower components of the drill string; at least one central pipe segment coupling the upper pipe connector to the lower pipe connector for conveying a flow of drilling fluid through the apparatus; drag elements mechanically coupled to at least one of the upper pipe connector and the lower pipe connector and disposed around a circumference of the apparatus; an actuator mechanism mechanically coupled to the drag elements for actuating the drag elements to extend the drag elements radially outward from the at least one central pipe segment to contact a wall of the well bore and to retract the drag elements radially inward out of contact with the well bore toward the at least one central pipe segment, the actuator mechanism being responsive to force transmitted between the upper pipe connector and the lower pipe connector to extend the drag elements radially outward from the at least one central pipe segment to contact the wall of the well bore when force upon cutters of the reamer becomes excessive.

In a sixteenth example, there is disclosed an apparatus according to the preceding fifteenth example, wherein the actuator mechanism is responsive to force transmitted between the upper pipe connector and the lower pipe connector to retract the drag elements from the wall of the well bore when the bottom hole assembly is being pulled up the well bore.

In a seventeenth example, there is disclosed an apparatus according to the preceding fifteenth or sixteenth example, wherein the drag elements are lobed cams having pinion gear teeth, and the actuator mechanism includes at least one rack engaging the pinion gear teeth to rotate the lobed cams to extend the lobes of the cams to contact the wall of the well bore.

In an eighteenth example, there is disclosed a bottom hole assembly according to the preceding fifteenth or sixteenth example, wherein the drag elements are pistons, and the actuator mechanism includes a respective link to each of the pistons.

In a nineteenth example, there is disclosed an apparatus according to any of the preceding examples fifteenth to eighteenth, wherein the controller includes a spring-loaded splined pipe joint in the at least one central pipe segment, the spring-loaded splined pipe joint having a variable length responsive to axial force upon the spring-loaded splined pipe joint, the actuator mechanism being mechanically coupled to the spring-loaded splined pipe joint to extend and retract the drag elements in response to the variable length of the spring-loaded splined pipe joint.

In a twentieth example, there is disclosed an apparatus according to any of the preceding examples fifteenth to eighteenth, which includes a load sensor producing a load signal sensing the force transmitted between the upper pipe connector and the lower pipe connector, and an electronic controller responsive to the load signal and electronically coupled to the actuator mechanism for activating the actuator mechanism when the load signal indicates an excessive load on the cutters of the reamer during the simultaneous drilling and reaming in the well bore.

The various examples described above are provided by way of illustration only and should not be construed to limit the scope of the disclosure. Therefore, many such details are neither shown nor described. Even though numerous characteristics and advantages of the present technology have been set forth in the foregoing description, together with details of the structure and function of the present disclosure, the disclosure is illustrative only, and changes may be made in the detail, especially in matters of shape, size and arrangement of the parts within the principles of the present disclosure to the full extent indicated by the broad general meaning of the terms used in the attached claims. It will therefore be appreciated that the embodiments described above may be modified within the scope of the appended claims. Claim language reciting "at least one of" a set indicates that one member of the set or multiple members of the set satisfy the claim.

What is claimed:

1. A method of simultaneous drilling and reaming using a drill bit and a reamer in a bottom hole assembly to bore and ream a well bore, said method comprising:

(a) obtaining an indication of force on cutters of the reamer, wherein obtaining the indication of force on the cutters of the reamer comprises converting axial force on a drag member of the bottom hole assembly to a variable length of the drag member;

(b) determining whether or not the indication of force on the cutters of the reamer indicates an excessive force on the cutters of the reamer, wherein the excessive force is indicated from a sensed weight on bit when the weight on bit is greater than a first threshold and less than a second threshold;

(c) in response to determining that the indication of force on the cutters of the reamer indicates an excessive force on the cutters of the reamer, extending drag elements from the bottom hole assembly to contact a wall of the well bore and reduce the force on the cutters of the reamer.

2. The method as claimed in claim 1, wherein when the drag elements contact the wall of the well bore and reduce the force on the cutters of the reamer, the drag elements do not cut the wall of the well bore.

3. The method as claimed in claim 1, further comprising obtaining the indication of force on the cutters of the reamer from an indication of force on the drill bit.

4. The method as claimed in claim 1, further comprising comparing indicated weight on the drill bit to a first threshold and a second threshold and finding that the indicated weight on the drill bit is between the first threshold and the second threshold to determine that the indication of force on the cutters of the reamer indicates an excessive force on the cutters of the reamer.

5. The method as claimed in claim 1, further comprising retracting the drag elements from the wall of the well bore in response to determining that the bottom hole assembly is being pulled up the well bore.

6. The method as claimed in claim 5, further comprising determining that the bottom hole assembly is being pulled up the well bore by comparing an indicated weight on the drill bit to a threshold and finding that the indicated weight on the drill bit is less than the threshold.

7. The method as claimed in claim 1, further comprising actuating a mechanical mechanism with the variable length of the drag member in order to extend the drag elements from the bottom hole assembly to contact the wall of the well bore.

8. The method as claimed in claim 1, further comprising a spring determining whether or not the indication of force on the cutters of the reamer indicates an excessive force on the cutters of the reamer in order to extend the drag elements to a contact the well bore wall when the force on the cutters of the reamer becomes excessive.

9. A bottom hole assembly for simultaneous drilling and reaming in a well bore, the bottom hole assembly comprising:

a reamer having cutters disposed around an outer circumference of the reamer;

a drill bit at a bottom end of the bottom hole assembly;

drag elements extendable from the bottom hole assembly to contact a wall of the well bore, wherein the drag elements are lobed cams having pinion gear teeth, and the actuator mechanism includes at least one rack engaging the pinion gear teeth to rotate the lobed cams to extend the lobes of the cams to contact the wall of the well bore;

an actuator mechanism mechanically coupled to the drag elements to extend the drag elements to contact a wall of the well bore and to retract the drag elements from the wall of the well bore during the simultaneous drilling and reaming;

a load sensor for producing a load signal indicating force on the cutters of the reamer during the simultaneous drilling and reaming; and an electronic controller electronically coupled to the load sensor for receiving the load signal and electronically coupled to the actuator mechanism for activating the actuator mechanism when the load signal indicates an excessive force on the cutters of the reamer during the simultaneous drilling and reaming in the well bore, wherein the excessive force is indicated from a sensed weight on bit when the weight on bit is greater than a first threshold and less than a second threshold.

10. The bottom hole assembly as claimed in claim 9, wherein the electronic controller is programmed to activate the actuator mechanism to retract the drag elements from the wall of the well bore in response to the load signal indicating that the bottom hole assembly is being pulled up the well bore.

11. A bottom hole assembly for simultaneous drilling and reaming in a well bore, the bottom hole assembly comprising:

a reamer having cutters disposed around an outer circumference of the reamer;

a drill bit at a bottom end of the bottom hole assembly;

drag elements extendable from the bottom hole assembly to contact a wall of the well bore;

an actuator mechanism mechanically coupled to the drag elements to extend the drag elements to contact a wall of the well bore and to retract the drag elements from the wall of the well bore during the simultaneous drilling and reaming; and a spring-loaded splined pipe joint having a variable length responsive to axial force upon the spring-loaded splined pipe joint, wherein the actuator mechanism is mechanically coupled to the spring-loaded splined pipe joint to extend and retract the drag elements in response to the variable length of the spring-loaded splined pipe joint.

12. An apparatus for a bottom hole assembly including a reamer and a drill bit for simultaneous drilling and reaming in a well bore, the apparatus comprising:

an upper pipe connector at an upper end of the apparatus for connecting the upper end of the apparatus to upper components of a drill string;

a lower pipe connector at a lower end of the apparatus for connecting the lower end of the apparatus to lower components of the drill string;

at least one central pipe segment coupling the upper pipe connector to the lower pipe connector for conveying a flow of drilling fluid through the apparatus;

drag elements mechanically coupled to at least one of the upper pipe connector and the lower pipe connector and disposed around a circumference of the apparatus, wherein the drag elements are lobed cams having pinion gear teeth, and the actuator mechanism includes at least one rack engaging the pinion gear teeth to rotate the lobed cams to extend the lobes of the cams to contact the wall of the well bore; and an actuator mechanism mechanically coupled to the drag elements for actuating the drag elements to extend the drag elements radially outward from the at least one central pipe segment to contact a wall of the well bore and to retract the drag elements radially inward out of contact with the well bore toward the at least one central pipe segment, the actuator mechanism being responsive to force transmitted between the upper pipe connector and the lower pipe connector to extend the drag elements radially outward from the at least one central pipe segment to contact the wall of the well bore when force upon cutters of the reamer becomes excessive, wherein the excessive force is indicated from a sensed weight on bit when the weight on bit is greater than a first threshold and less than a second threshold.

13. The apparatus as claimed in claim 12, wherein the actuator mechanism is responsive to force transmitted between the upper pipe connector and the lower pipe connector to retract the drag elements from the wall of the well bore when the bottom hole assembly is being pulled up the well bore.

14. The apparatus as claimed in claim 12, which further comprises a spring-loaded splined pipe joint in the at least one central pipe segment, the spring-loaded splined pipe joint having a variable length responsive to axial force upon the spring-loaded splined pipe joint, the actuator mechanism being mechanically coupled to the spring-loaded splined pipe joint to extend and retract the drag elements in response to the variable length of the spring-loaded splined pipe joint.

15. The apparatus as claimed in claim 12, which further comprises a load sensor producing a load signal sensing the force transmitted between the upper pipe connector and the lower pipe connector, and an electronic controller responsive to the load signal and electronically coupled to the actuator mechanism for activating the actuator mechanism when the load signal indicates an excessive force on the cutters of the reamer during the simultaneous drilling and reaming in the well bore.

16. A bottom hole assembly for simultaneous drilling and reaming in a well bore, the bottom hole assembly comprising:

a reamer having cutters disposed around an outer circumference of the reamer;

a drill bit at a bottom end of the bottom hole assembly;

drag elements extendable from the bottom hole assembly to contact a wall of the well bore, wherein the drag elements are pistons, and the actuator mechanism includes a respective link to each of the pistons;

an actuator mechanism mechanically coupled to the drag elements to extend the drag elements to contact a wall of the well bore and to retract the drag elements from the wall of the well bore during the simultaneous drilling and reaming;

a load sensor for producing a load signal indicating force on the cutters of the reamer during the simultaneous drilling and reaming; and an electronic controller electronically coupled to the load sensor for receiving the load signal and electronically coupled to the actuator mechanism for activating the actuator mechanism when the load signal indicates an excessive force on the cutters of the reamer during the simultaneous drilling and reaming in the well bore, wherein the excessive force is indicated from a sensed weight on bit when the weight on bit is greater than a first threshold and less than a second threshold.

17. An apparatus for a bottom hole assembly including a reamer and a drill bit for simultaneous drilling and reaming in a well bore, the apparatus comprising:

an upper pipe connector at an upper end of the apparatus for connecting the upper end of the apparatus to upper components of a drill string;

a lower pipe connector at a lower end of the apparatus for connecting the lower end of the apparatus to lower components of the drill string;

at least one central pipe segment coupling the upper pipe connector to the lower pipe connector for conveying a flow of drilling fluid through the apparatus;

drag elements mechanically coupled to at least one of the upper pipe connector and the lower pipe connector and disposed around a circumference of the apparatus, wherein the drag elements are pistons, and the actuator mechanism includes a respective link to each of the pistons; and an actuator mechanism mechanically coupled to the drag elements for actuating the drag elements to extend the drag elements radially outward from the at least one central pipe segment to contact a wall of the well bore and to retract the drag elements radially inward out of contact with the well bore toward the at least one central pipe segment, the actuator mechanism being responsive to force transmitted between the upper pipe connector and the lower pipe connector to extend the drag elements radially outward from the at least one central pipe segment to contact the wall of the well bore when force upon cutters of the reamer becomes excessive, wherein the excessive force is indicated from a sensed weight on bit when the weight on bit is greater than a first threshold and less than a second threshold.

* * * * *